US005269442A

United States Patent [19]

Vogel

[11] Patent Number: 5,269,442

[45] Date of Patent: Dec. 14, 1993

[54] NOZZLE FOR A BEVERAGE DISPENSING VALVE

[75] Inventor: James D. Vogel, Anoka, Minn.

[73] Assignee: The Cornelius Company, Anoka, Minn.

[21] Appl. No.: 887,458

[22] Filed: May 22, 1992

[51] Int. Cl.[5] ..... B67D 5/56

[52] U.S. Cl. ..... 222/129.1; 222/564; 239/590.5

[58] Field of Search ..... 222/129.1-129.4, 222/564, 566; 239/590.5

[56] References Cited

U.S. PATENT DOCUMENTS 4,928,854 5/1990 McCann et al. ..... 222/129.1
4,986,447 1/1991 McCann et al. ..... 222/129.1 X
5,033,648 7/1991 Nakayama et al. ..... 222/129.1
5,048,726 9/1991 McCann et al. ..... 222/129.1

*Primary Examiner*—Gregory L. Huson
*Attorney, Agent, or Firm*—Sten Erik Hakanson

[57] ABSTRACT

A nozzle for a post-mix beverage dispensing valve is shown for optimizing flow at flow rates above 3.5 oz./-sec. The nozzle includes a first diffuser plate followed by a central flow piece having a frusto-conical outer water flow surface and an interior syrup flow channel. Second and third diffuser plates follow the frusto-conical portion. The second and third diffuser plates have perimeter edges that contact the inner surface of a nozzle housing so that the carbonated water must flow through holes in the diffusers. In this manner the gradual reduction of pressure of the carbonated water to atmospheric can be controlled in part by increasing the surface area of the holes in each successive diffuser.

3 Claims, 3 Drawing Sheets 10
36
34
14
4
4
24
12
27
26a
3
28
26
30
25
16
18
52
44
3
32
72
69
70

NOZZLE FOR A BEVERAGE DISPENSING VALVE

BACKGROUND OF THE INVENTION

1. Field of the Invention

The present invention relates generally to beverage dispensing valves and, in particular, to post-mix beverage dispensing valves.

2. Background

Post-mix beverage dispensing valves are well known in the prior art and provide in the nozzle structure thereof for the simultaneous mixing of a water and syrup component for the production of a beverage. Standard flow rates for such valves are typically 1 ½ to 3 ounces per second; however, flow rates of 4 ½ to 6 ounces are now also becoming desirable. However, the higher flow rates present a challenge as there exists a greater possibility for foam production, improper brix and loss of carbonation. Accordingly, it would be highly desirable to provide for a post-mix nozzle that accommodates such higher flow rates and does so with a structure that is relatively simple in design and that easy and inexpensive to manufacture.

In addition, as post-mix valves are required to provide an accurate brix at a desired flow rate, and to maintain such precision it is well understood in the industry that such valves periodically need cleaning, adjusting and other maintenance. Accordingly, it would be desirable to have a post-mix valve wherein the internal components are quickly and easily accessible, adjustable and repairable. And in particular, it would be desirable to provide for such easy access in an electronic portion controlled valve.

SUMMARY OF THE INVENTION

A nozzle for a post-mix beverage dispensing valve is shown for optimizing flow at flow rates above 3.5 oz./-sec. The nozzle includes a first diffuser plate followed by a central flow piece having a frusto-conical outer water flow surface and an interior syrup flow channel. Second and third diffuser plates follow the frusto- conical portion. The three diffuser plates have perimeter edges that contact the inner surface of a valve body portion perimeter rim or a nozzle housing so that the carbonated water must flow through holes in the diffusers. In this manner the gradual reduction of pressure of the carbonated water to atmospheric can be controlled in part by increasing the surface area of the holes in each successive diffuser.

The present invention further includes a valve housing including a main valve housing portion, a valve base and a front access cover. The main housing portion is first slideably engageable with the valve base, after which the front cover is slideably engageable with the main housing portion in a direction substantially transverse to the sliding engagement of the housing portion with the valve base. In addition, when the access cover is slideably engaged with the valve base, the access cover prevents the main housing portion from disengaging from the valve base. In this manner, the housing covering the internal working components of the present beverage valve can be removed quickly and easily to provide for access thereto. In the present invention, the interior components are arranged to provide space for an electronic control/switch module. The access cover is modified to accommodate the module wherein the two are not physically connected. Thus, the interior of the valve can be more easily accessed as compared to prior art electronic pour controlled valves wherein the control switches are secured to the access cover and wired to interior valve components.

DESCRIPTION OF THE DRAWINGS

A better understanding of the structure and the objects and advantages of the present invention can be had by reference to the following detailed description which refers to the following figures, wherein.

DETAILED DESCRIPTION

Figure 1:
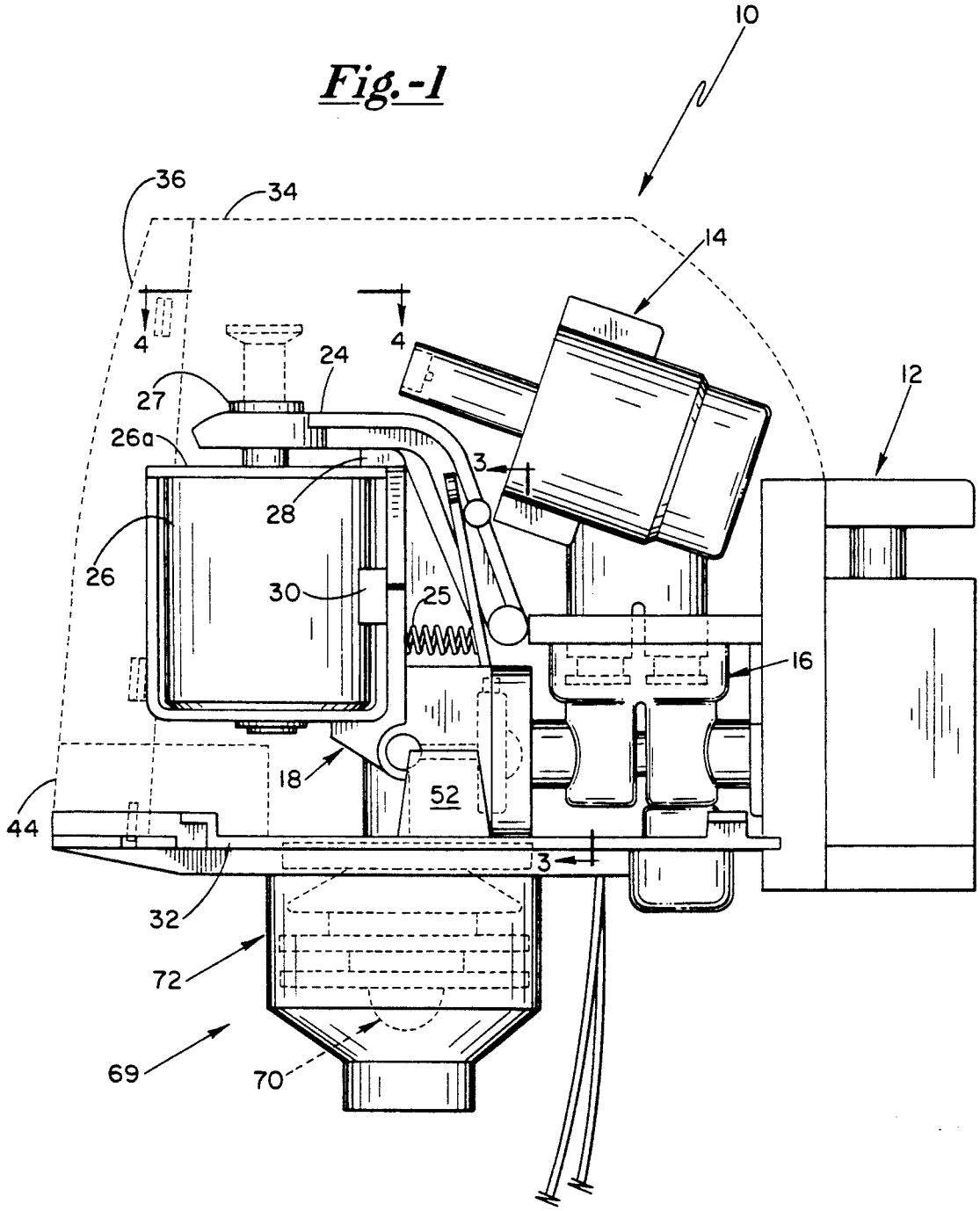
FIG. 1 shows a side plan partial cross-sectional view of the valve of the present invention.
Figure 3:
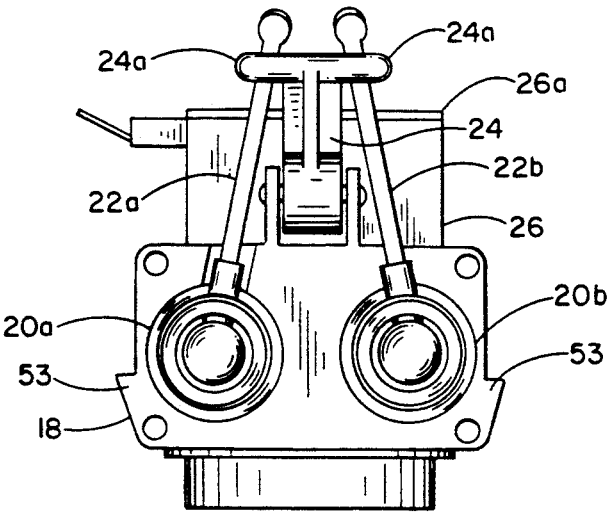
FIG. 3 shows an end plan view along lines 3—3 of FIG. 1.

The post-mix beverage dispensing valve of the present invention is seen in FIG. 1 and referred to by the numeral 10. Valve 10 includes a quick disconnect 12 and a modular or interchangeable flow control 14. Disconnect 12 provides for releasable connection to sources of carbonated water and syrup, not shown. Disconnect 12 and control 14 are substantially the same as shown in co-pending application Ser. No. 07/795,568, which application is incorporated herein by reference thereto. Flow control 14 is releasably secured to valve body portion 16, and portion 16 is secured to valve body portion 18. As seen by also referring to FIG. 3, a pair of banjo valves **20*a* and 20*b* are secured between body portions 16 and 18 and include valve arms 22*a* and 22*b***.

Figure 4:
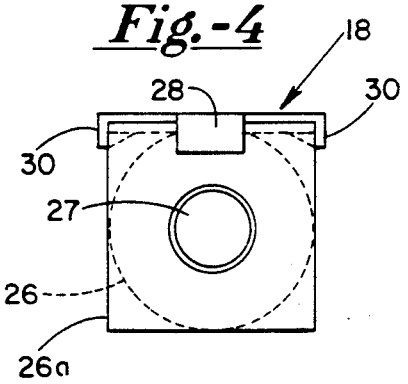
FIG. 4 shows a top plan view along lines 4—4 of FIG. 1.

A valve actuating arm 24 is pivotally secured to valve portion 18 and includes horizontal extensions **24*a* for cooperating with arms 22*a* and 22*b*. A pair of return springs 25 extend between 22*a* and 22*b* and body portion 18. A solenoid 26 has an outer metal jacket or housing 26*a*, an operating piston 27 and is secured to body portion 18. In particular, as seen by also referring to FIG. 4 body portion 18 includes a top tab 28 and flexible side tabs 30. Tabs 30 provide for snap fitting engagement with solenoid jacket 26*a* for securing solenoid 26 to body portion 18. Valve portions 16 and 18 are secured to a base plate 32 and portion 28 is designed so that solenoid 26 is held above valve base plate 32**.

Figure 5:
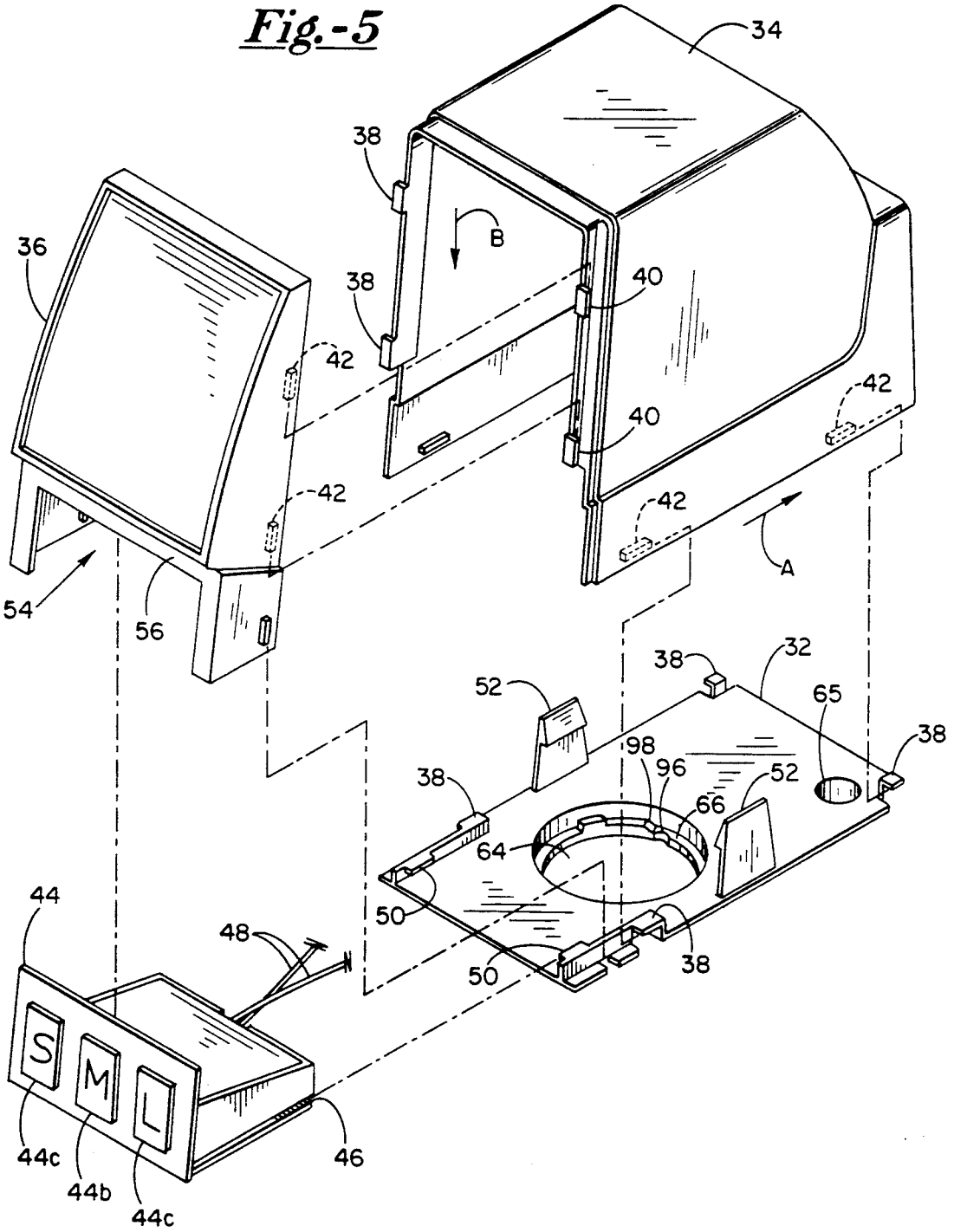
FIG. 5 shows a perspective view of the outer housing, access plate and base plate of the valve of the present invention.

As seen in FIG. 5, the valve herein includes an outer housing consisting of a main outer housing 34 and an access cover 36. As also seen in the above referenced U.S. patent application Ser. No. 07/795,568, housing 34 includes a plurality of L-shaped tabs 38 defining slots 40 for receiving tabs 42 of cover 36. Base plate 32 also includes a plurality of tabs 38 for receiving tabs 42 on housing 34. Thus, housing 34 is slidably engageable with base 32 by movement in the direction of arrow A of FIG. 5, and cover 35 is slidably engageable with housing 34 by movement in the direction of arrow B of FIG. 5. In this manner by first slideably engaging housing 24 with base 32 followed by engaging cover 36 with housing 34 a protective housing is provided for the internal components of valve 10 that is quickly and securely attached thereto and removed therefrom without the need of any tools such as a screwdriver or the like.

Valve 10 includes a electronic control/switch module 44. Module 44 contains an electronic circuit board, not shown, and a plurality of size selection switches 44*a*, 44*b*, 44*c*, 44*d* for providing dispensing control of valve 10. Valve 10 is of the portion controlled type, well known in the art, wherein various sized drinks are automatically dispensed based upon pre-programming of the electronic control thereof. Thus activation of one of the switches 44*a–d* provides for a particular volume of dispensed beverage as a function of time of valve operation. Module 44 includes a groove 46 and has a plurality of wires 48 extending therefrom for connecting to a source of power and for operating solenoid 26. Base plate 32 includes a ridge 50 extending between a pair of vertical flanges 52. Cover 34 also includes a recessed area 54 and a top retaining lip 56.

Figure 2:
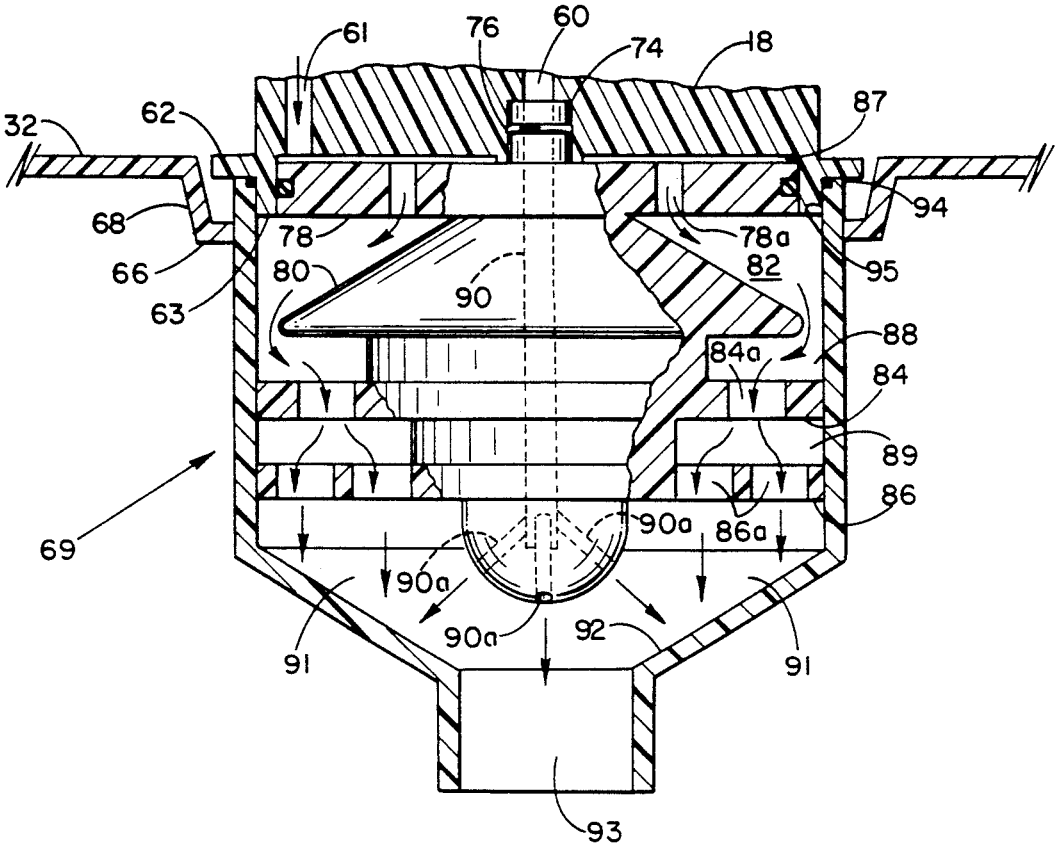
FIG. 2 shows an enlarged cross-sectional view of the nozzle of the present invention.

As seen in FIGS. 1 and 2, body portion 18 includes a syrup channel 60, a carbonated water channel 61, a horizontal perimeter rim 62 and a vertical perimeter rim 63. Valve body portion 18 extends, in part, into a hole 64 extending through plate 32. Plate 32 includes a horizontal lip 66 and vertical area 68 extending around and defining the perimeter of hole 64. Plate 32 also includes a hole 65 for providing releasable securing of cup actuating lever. A nozzle 64 is releasably securable to body portion 18 and base plate 32 and includes two primary components, a pressure reducing central portion 70 and an outer retainer or housing 72. Pressure reducer 70 includes a tube end portion 74 having an o-ring 76 extending there around and sized for sealable inserting into syrup channel 60. Tube end 74 is integral with a first plate 78 having a plurality of holes 78*a* extending there through. A frusto-conical portion 80 extends from plate 78 and defines an annular space 82 between portion 80, plate 78 and retainer 72. A second plate 84 is spaced from portion 80 and includes a plurality of holes 84 there through. A third plate 86 is spaced from second plate 84 and also includes plurality of holes 86 there through. An annular space 87 exists between plate 78 and body portion 18 and an annular space 88 exists between portion 80 and second plate 84. A further annular space 89 is defined between second plate 84 and third plate 86. A syrup channel 90 extends through central portion 70, and terminates with a plurality of angled syrup channels 90*a*. Channels 90*a* provide for dispensing of syrup into a nozzle mixing space 91 for combining thereof with carbonated water as described more fully below. Retainer 72 includes an angled shoulder 92 and a dispensing orifice 93. Retainer 72 also includes a chamfer 95 around a top edge thereof for cooperating with an o-ring 94 extending around rim 63 at the juncture thereof with rim 62 for providing sealing of space 82. Retainer 72, and in turn, pressure reducer 74 held therein, are secured to base plate 32 by a bayonet fitting. Specifically, tabs, not shown, extending from retainer 72 opposite chamfer 95 are inserted into slots 96 of lip 62, after which retainer 72 is turned causing the retainer tabs to ride upwardly on ramps 98 drawing retainer 72 into sealing engagement between lip 62 of plate 32 and body portion 18.

It can now be appreciated that the retaining of solenoid 26 above base plate 32 provides space for control module 44. In addition, groove 46 cooperates with ridge 50 so that module 44 is retained thereon between plates 52. Moreover, when access cover 34 is slid into place, lip 56 also serves to retain module 44. Thus, cover 34 and housing 36 can be fully removed while module 44 remains in place. This ability represents an improvement over prior art valves wherein the pour switches and or electronics are secured to an access cover as per cover 34 and, in turn, wired to the solenoid and power supply.

In operation, actuation of one of the switches 44*a–d* causes the powering of solenoid 26 so that arm 24 is operated by piston 27 to actuate valve arms 22*a* and 22*b*. It can be appreciated that arm 24 operates to provide a lever advantage in the operating of stems 22*a* and 22*b* of valves 20*a* and 20*b*. Thus, solenoid 24 can smaller and less expensive than the prior art arrangement wherein the solenoid piston directly actuates the valve stems.

Nozzle 64 provides for the gradual reduction in pressure of the beverage components from that as supplied by the flow control means 14 to that of atmospheric. In this manner the syrup and carbonated water can be relatively gently mixed so that foaming and loss of carbonation is reduced. In particular, when nozzle 64 is secured to valve body 18, tube end 74 is sealably inserted into syrup channel 60 whereby diffuser plate 78 is inserted partially into the area defined by rim 63 and body portion 18 forming annular space 87. When valves 20*a* and 20*b* are operated syrup and carbonated water flow through channels 60 and 61 respectively. The carbonated water first flows into space 87 and then through holes 78*a* of diffuser 78 and into cavity 82. In cavity 82 the carbonated water then flows over the surface of frusto-conical portion 80 and is dispersed over a greater surface area thereby and is then directed to space 88 and over diffuser plate 84. The carbonated water next flows through holes 84 into space 89 and then through holes 86*a* of diffuser 86 and then into area 91. In area 91 the carbonated water flows in part along the surface of shoulder 92 and in part downward from diffuser 86. The syrup flows through channel 90 and exits channels 90*a* in a direction towards inclined shoulder 92. Thus, the syrup is mixed with the carbonated water wherein the stream thereof flowing from channels 90*a* contacts the water as it flows downward from plate 86 and contacts the syrup stream and as a portion of the stream contacts shoulder 92 and combines with the portion of water flowing along the surface thereof. The water and syrup are then substantially combined and flow out of orifice 93 and into a suitable receptacle. An important aspect of the present invention concerns the gradual reducing in pressure of the carbonated water to that of atmospheric. That is accomplished in the several steps outlined above. Specifically, there is a partial reduction in pressure when the water flows into each successive annular space wherein the surface area of the holes in plates 78, 84 and 86 increases from plate to plate in the direction of flow. Conical surface 80 also serves to decrease the velocity of flow by distribution over a larger surface area in addition to reducing the pressure partially to atmospheric. A further important aspect of plates 78, 84 and 86 concerns the perimeters thereof contacting the inner surface of retainer 72. In this manner the reduction in pressure as a function of the surface area of holes therein can be controlled solely as a function of such surface area. This situation is in contrast to the prior art valve inserts wherein the diffuser plates thereof permit the flow of beverage between the perimeter diffuser edge and the nozzle outer housing. It can also be desirable to secure the perimeter edge of one or more of the diffuser plates 78, 84 and 86 to the inner surface of retainer 72 to better prevent beverage flow there between.

What is claimed is:

1. A nozzle for use in a beverage dispensing valve, the valve connectable to sources of carbonated water and syrup and having a body portion having a carbonated water channel and a syrup channel, and the carbonated water channel and syrup channels terminating in a first valve body cavity wherein the syrup channel terminates centrally of the body cavity, the nozzle comprising:

a nozzle housing having an inner surface defining a central space thereof, the nozzle housing also having a top open end for securing to the valve body portion and a bottom drink dispensing opening, a pressure reducing portion retained within the central space and the reducing portion having a central syrup channel and means for providing sealing engagement between the valve body syrup channel of the first body cavity and the reducing portion syrup channel, and the pressure reducing portion having a first diffuser plate for sealing inserting into the body cavity for creating a first annular space extending around the centrally terminating syrup channel wherein the first annular space is in fluid sealed communication with the valve body carbonated water channel, and the first plate having a plurality of holes there through, and the reducing portion having a frusto-conical portion extending below the first plate and defining a conical surface increasing in area in a direction of flow there along away from the first plate from an upper frusto-conical portion end to a lower frusto-conical portion end and the upper end having a diameter less than that of the first plate and the lower end having a diameter less than that of the nozzle housing, and the reducing portion having a second plate, the second plate having a plurality of holes extending there through and the second plate spaced from the lower frusto-conical portion end, and the pressure reducing portion having a third diffuser plate substantially parallel to and spaced from the second plate, and the third plate having a plurality of holes there through, and the second and third diffuser plates having perimeter edges closely adjacent the housing inner surface so that carbonated water can not flow there between.

2. The nozzle as defined in claim 1, and the total surface area of the holes in the second plate being larger than the total surface area of the holes in the first plate.

3. The nozzle as defined in claim 2, and the total surface area of the holes in the third plate being larger than the total surface area of the holes in the second plate.

* * * * *